United States Patent [19]

Pinnow

[11] Patent Number: 4,868,559

[45] Date of Patent: Sep. 19, 1989

[54] SECURITY SYSTEM EMPLOYING OPTICAL KEY SHAPE READER

[75] Inventor: Douglas A. Pinnow, Laguna Hills, Calif.

[73] Assignee: Universal Photonix, Inc., Laguna Hills, Calif.

[21] Appl. No.: 103,646

[22] Filed: Oct. 2, 1987

[51] Int. Cl.[4] ..... E05B 47/00

[52] U.S. Cl. ..... 340/825.31; 70/278; 70/DIG. 51; 361/172

[58] Field of Search ..... 340/825.31, 825.34, 340/64; 70/277, 278, DIG. 51; 361/172, 173; 235/382

[56] References Cited

U.S. PATENT DOCUMENTS

| | | | |
|---|---|---|---|
| 3,733,862 | 5/1973 | Killmeyer | 70/277 |
| 3,797,939 | 3/1974 | Pryor | 356/111 |
| 3,840,857 | 10/1974 | Knight et al. | 340/146.3 F |
| 3,843,261 | 10/1974 | Pryor | 356/111 |
| 4,050,063 | 9/1977 | Schull | 340/274 C |
| 4,142,387 | 3/1979 | Bergkvist | 70/278 |
| 4,144,523 | 3/1979 | Kaplit | 340/149 R |
| 4,148,372 | 4/1979 | Schroeder | 180/114 |
| 4,237,375 | 12/1980 | Granholm | 235/487 |
| 4,280,119 | 7/1981 | May | 340/147 |
| 4,288,780 | 9/1981 | Theodoru | 340/146.3 Z |
| 4,298,792 | 11/1981 | Granholm | 235/474 |
| 4,322,719 | 3/1982 | Moorhouse | 235/383 |
| 4,326,124 | 4/1982 | Faude | 235/382 |
| 4,404,684 | 9/1983 | Takada | 382/25 |
| 4,415,893 | 11/1983 | Roland | 340/825.31 |
| 4,583,148 | 4/1986 | Lipschütz | 361/172 |
| 4,594,505 | 6/1986 | Sugimoto | 70/DIG. 51 |

FOREIGN PATENT DOCUMENTS

| | | | |
|---|---|---|---|
| WO87/00233 | 1/1987 | PCT Int'l Appl. | 70/278 |

OTHER PUBLICATIONS

General Motors, RM#53-67, 2/20/85, pp. 1-22.

*Primary Examiner*—Donald J. Yusko
*Attorney, Agent, or Firm*—Bacon & Thomas

[57] ABSTRACT

A security system which employs an optical key shaped reader to photoelectrically derive an electrical signal from a shape characteristic of a key is disclosed. The system provides heightened security over standard key operated systems and is particularly well suited for use in motor vehicles.

16 Claims, 4 Drawing Sheets

SECURITY SYSTEM EMPLOYING OPTICAL KEY SHAPE READER

BACKGROUND OF THE INVENTION

1. Technical Field of the Invention

The subject invention is a security system which employs an optical key shape reader. The system is particularly suited for use in automobiles and other motor vehicles.

2. Description of the Prior Art

Automobile theft has become an increasingly prevalent problem for our society. In particular, expensive sports and luxury cars have become targets for thieves. Simple key locks for such vehicles are no match for experienced thieves who are able to enter and start the vehicles in a matter of seconds.

In an effort to increase the security of automobiles, efforts have been made to develop new, high security systems. Once such a system was introduced by General Motors Corporation in 1986 for its Corvette model line. The system is called a Vehicle Anti Theft System or VATS. This system is described in detail in a paper entitled "The Vehicle Anti-Theft System—VATS" by Schroeder et al, SAE Technical Paper Series, 1986.

As described therein, VATS uses a modified ignition key with an electrical resistor pellet embedded in the upper shaft of a standard key. The electrical resistor has one of fifteen possible resistance values. In order to start the car, the VATS ignition key must have the proper cuts, like any conventional key, as well as the correct resistant value. The resistance of the pellet is sensed by electrical contacts built into the ignition lock. These contacts are connected by wires to a remote VATS module where the decision is made if the correct resistor pellet is in the key. The significant feature about VATS is that the decision to accept or reject the key is made remote from the ignition lock and steering column. This defeats the most common mode of automative theft which is to use a hammer to crack open the plastic housing that surrounds the steering column and ignition lock, followed by the use of a screw driver to force the ignition mechanical linkages to start the ignition. The VATS module is located behind the instrument panel, heating ducts and electrical wiring so that a thief would have to spend a considerable time to reach the module to disconnect it.

While at first blush it may appear that the fifteen resistor values are too few in number to achieve appreciable additional security, if the wrong resistor is selected, a time delay of from two to four minutes is imposed before the system will accept another resistance value. On the average, it will take seven or eight attempts before the correct resistor is randomly selected. This will cause the thief to be at risk of being caught for as long as a half an hour, long enough to deter many, but not all, thieves.

While VATS have provided increased security for vehicles in which it is installed, it has experienced numerous problems which prevent a legitimate owner from starting his automobile. These problems include: the resistor pellets falling out of the keys; bent electrical contacts in the lock often caused by the operator rotating the key before it is fully inserted in the lock; added series resistance due to corrosion of the electrical contacts resulting in invalid readings; fraying of the wires of the lock contacts which rotate every time the car is turned on or off and the expense and inconvenience of obtaining replacement or duplicate keys from locksmiths. Accordingly, there remains a need in the art for a security system having particular application to motor vehicles, which provides heightened security without being subject to the problems which characterize existing security systems such as VATS.

SUMMARY OF THE INVENTION

The present invention overcomes the shortcomings of existing security systems, including VATS, by utilizing a shape characteristic of a key such as one or more cuts in a standard key to photoelectrically derive an electrical signal that can be processed at a remote location. In automobiles, this location is remote from the ignition lock and steering column, typically behind the dashboard. The electrical signal can also be photoelectrically derived from a pattern of slots or holes which is introduced into the upper or lower shaft of a conventional key.

The security system of the invention comprises means for photoelectrically deriving an electrical signal from the shape of a key, means which may be remote from said photoelectrical means for comparing said electrical signal to one or more electrical signals stored in memory to determine whether they are the same and means for enabling a function upon determination that the photoelectrically derived electrical signal is the same as an electrical signal stored in memory. In motor vehicles the function that is enabled upon receipt of the proper signal is the starter and/or fuel injector of the vehicle. Other appropriate functions include the deactivation of an electronic lock or other security device.

BRIEF DESCRIPTION OF THE FIGURES OF DRAWING

DETAILED DESCRIPTION OF THE PREFERRED EMBODIMENTS

Figure 1:
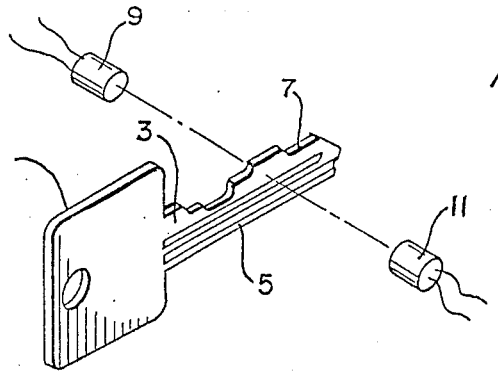
FIG. 1 is a representation of the manner in which an electrical signal is photoelectrically derived from the shape of a key.
Figure 2:
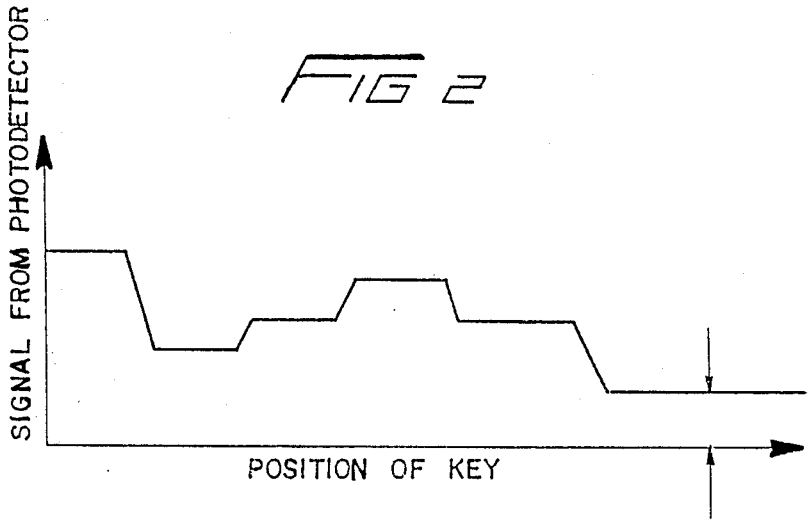
FIG. 2 is a graph showing the relationship between the signal generated by the intensity of light received by a photodetector and the position of a key in the system of the invention.

FIG. 1 illustrates one way in which an electrical signal can be photoelectrically derived from the shape of a standard key. Key 1 is comprised of an upper shaft portion 3 and a lower shaft portion 5. The lower shaft portion contains a plurality of cuts 7 which uniquely define the key code or shape. Light emitting diode 9 and photodiode 11 are positioned opposite one another, perpendicular to the path traversed by the key when it is inserted in a lock. As the key is inserted, the lower shaft portion blocks a portion of the light being transmitted by the light emitting diode to the photodiode. The intensity of light received by the photodiode is directly related to the depth of the cuts in the lower shaft portion of the key. Hence, as depicted in FIG. 2, a plot of the intensity of the signal from the photodiode reproduces the shape of the key. The signal from the photodiode is transmitted through wires to a remote location where it is analyzed to determine whether it corresponds to a valid key shape. This analysis is performed by a processor which compares the signal from the photodiode to one or more valid signals stored in its memory. If the signals match, the processor issues an enable signal to enable the appropriate function, i.e., enabling the starter or fuel injector of a motor vehicle.

To insure that the optical key shape reader is tolerant to partial obscuration or change in brightness of the light emitting diode, the system preferably includes a self-calibration method. Each time a key shape is read a new optical reference level is established before the key is inserted and immediately after the key is fully inserted into the lock. For example, the difference between these two signal levels is simply divided into five equal parts corresponding to the different cut depths in a standard metal key such as the five depths used by General Motors.

Figure 3:
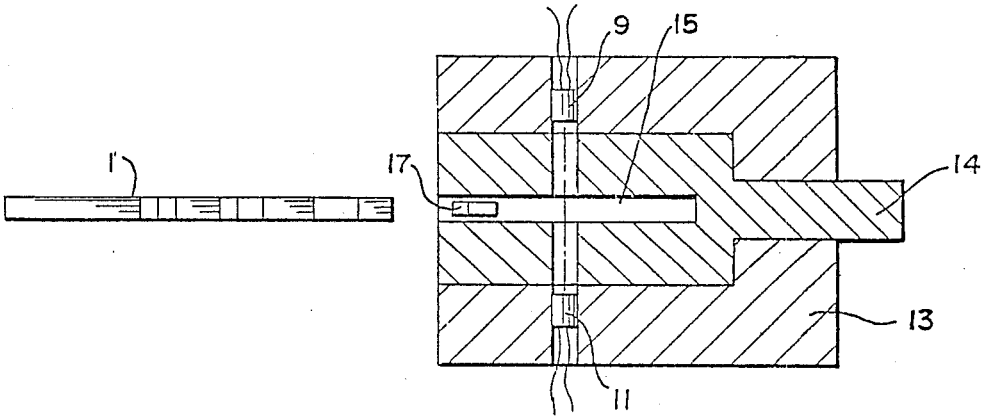
FIG. 3 is a cross sectional view of an ignition lock for a motor vehicle containing an optical key shape reader in accordance with the invention.

FIG. 3 shows a design for a key shape reader in which the light emitting diode 9 and the photodetector 11 are incorporated into the shell off an ignition lock 13. It is beneficial to locate these electro-optic components in the shell which remains in a fixed position when the core of the lock 14 is rotated. This eliminates fatigue failure of the electrical wires needed to operate the device. When key 1 is inserted into the key chamber 15 it trips switch 17 and turns on the key shape reader which generates a photoelectrical signal corresponding to the shape of the key.

Figure 4:
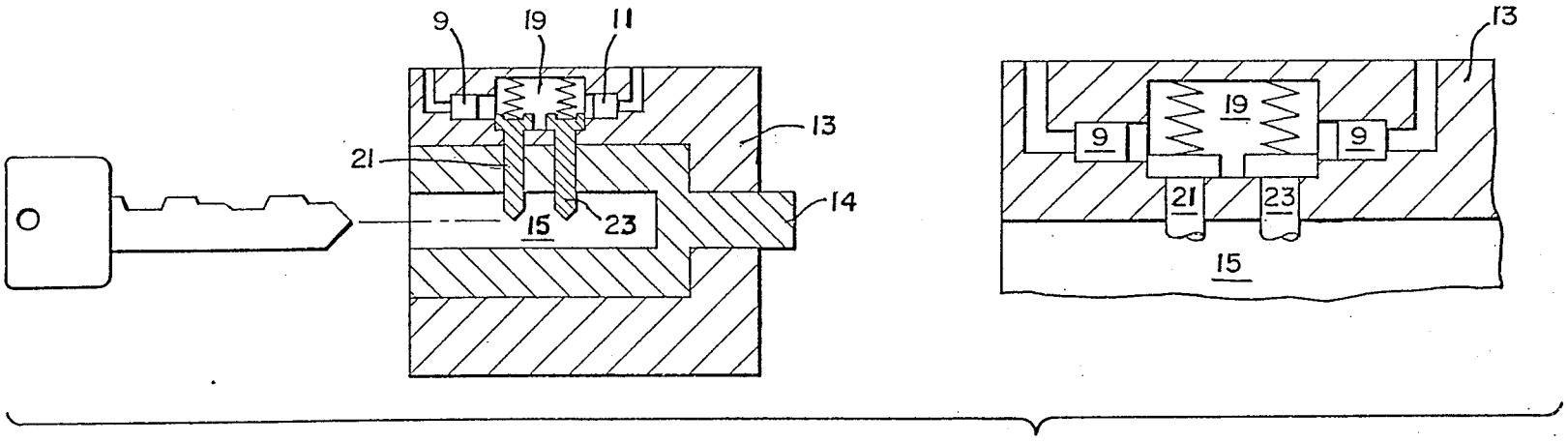
FIG. 4 is a cross sectional view of an alternative design for a ignition lock with an optical key shape reader in accordance with the invention.

FIG. 4 shows an alternative lock design which includes a separate clean chamber 19 above the key chamber 15 for housing the optical shape reader. In this embodiment, the shape reader is activated when the key is inserted into the key chamber causing a first pin 21 to trip a microswitch (not shown). As the key moves further into the key chamber it pushes against a second pin 23. As pin 23 is displaced upwards in the clean chamber by the pattern of cuts in the lower shaft portion of the key, it obscures the path of light being transmitted by the light emitting diode 9 to the photodetector 11. This results in a photoelectrical signal from the photodiode which corresponds to the shape of the key.

Figure 5A:
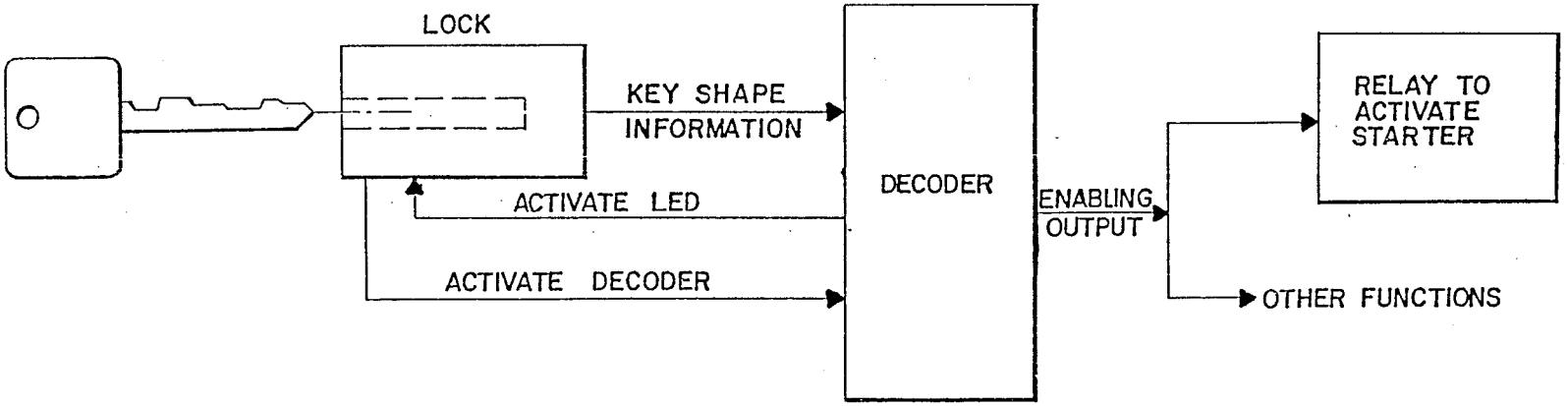
FIG. 5A is a schematic representation of the security system of the invention applied to a motor vehicle.

FIG. 5A shows schematically the relationship between the optical key shape reader and the remote processing means, referred to generally as the decoder, for analyzing the signal from the photodetector in the key shape reader and comparing it to one or more signals stored in a memory unit of the processing means to determine if the signal corresponds to a valid key. If so, the processing means issues enable signals for particular functions. In the case of an automobile, the enable signal energizes a relay switch which activates a component required to start the automobile, e.g., the starter solenoid and/or the fuel injector system. In some cases an electronically activated shut off valve in the fuel line may also be energized.

Figure 5B:
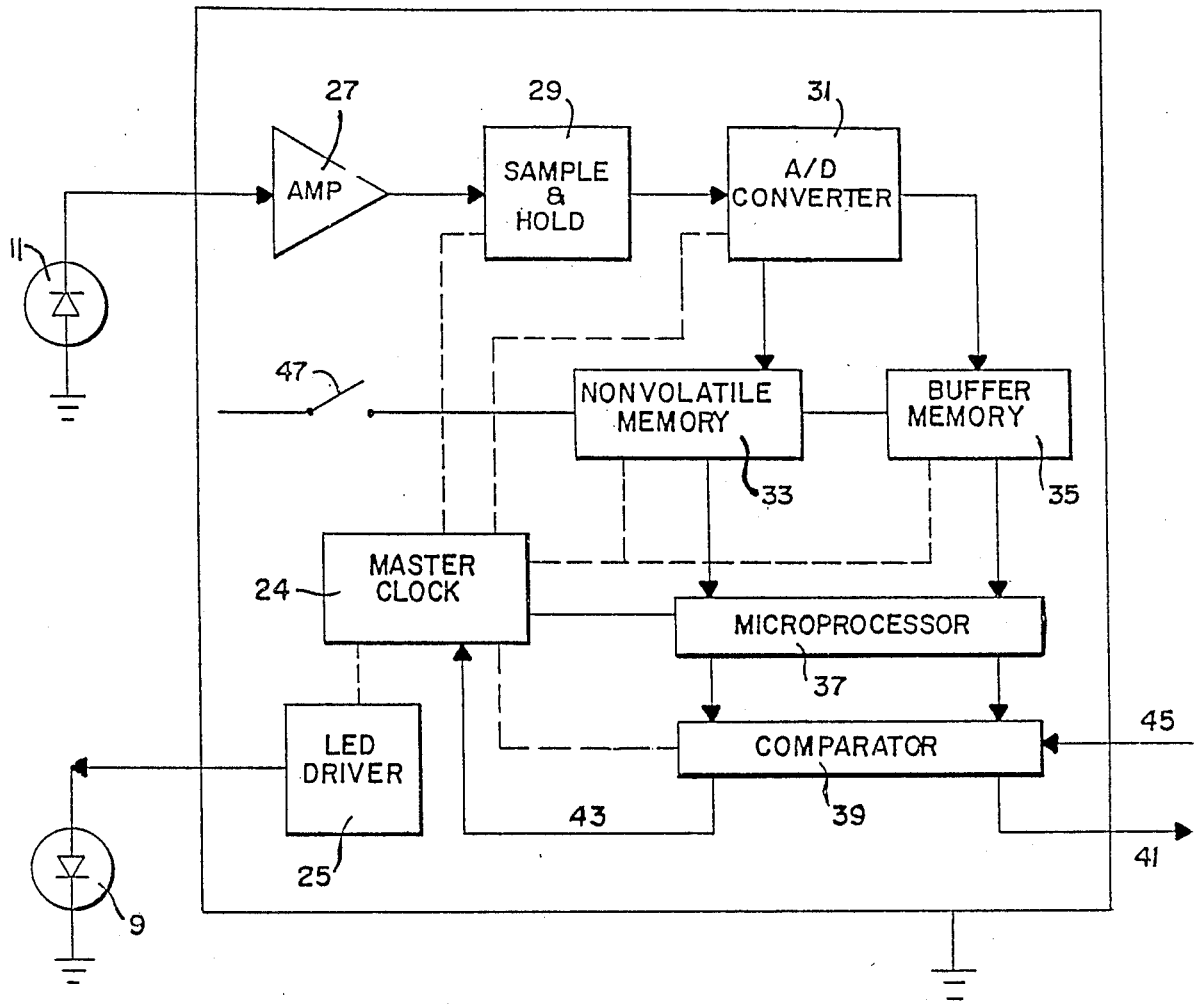
FIG. 5B is a schematic representation of the decoder portion of the system shown in FIG. 5A.

FIG. 5B is a detailed drawing showing the components contained in the decoder. The decoder is a processor for verifying key shape information and for introducing an enabling signal if verification occurs. A master clock 24 is used to provide the AC modulated signal to LED driver 25, as well as all the electronic timing functions for the memories, processor, etc. The intensity of the signal received by the photodiode 11 is modulated in time as the key is inserted into the lock. This modulated signal is amplified by amplifier 27 and then periodically sampled by the sample and hold unit 29. After sampling, the analog signal is digitized by the A/D converter 31 and directed to a memory. The very first signal received when a key is inserted is sent to a nonvolatile memory 33 where it serves as a permanent reference signal for the correct key. For all subsequent operations, the signal is sent to a buffer memory 35. The outputs from the nonvolatile memory and buffer memory are both processed to extract the essential key shape information in the processor 37 and then compared in the comparator 39. A match results in an enabling output 41 while a mismatch results in a time delay 43. An optional, yet desirable, feature is to delay the enabling output from the comparator until it receives a signal 45 that the ignition lock was rotated to the "start" position. This avoids starting a time delay sequence until the mechanical portion of the key code is validated by the mechanical position of the lock. A reset switch 47 is added to clear the nonvolatile memory in the event that the ignition lock is replaced and a new key code is used.

In operation, the master clock typically operates at 30 to 40 KHz to modulate the LED. Sampling of the received signal is performed 500 times per second for a period of up to 5 seconds and digitilization requires 4 bits per sample. These parameters determine the size of the memories each at approximately 10,000 bits.

Figure 6:
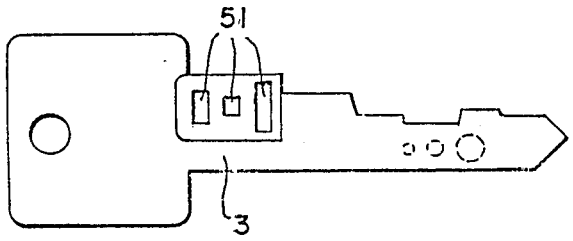
FIG. 6 is a representation of an alternative design for a key for use with the security system of the invention.

FIG. 6 shows an alternative key design for use with the security system of the invention. Instead of using the cuts in a conventional key, it uses a series of three slots 51 in the upper shaft portion 3 of the key. The heights of the three slots are optically read in sequence as the key is inserted into the lock.

One of the slots which is optically read should desirably be full height, representing the 100% calibration level. In FIG. 6, the first slot is full height. The second slot has four levels corresponding to twenty, forty, sixty and eighty percent of full height. The third slot has five levels, corresponding to twenty through one hundred percent, in equal increments. The total number of combinations is, therefore, $4\times5=20$. However, it is desirable to exclude combinations where the second and third slots are cut to the same level because the electronics may become confused. This eliminates four combinations, leaving a balance of sixteen possibilities. This is similar to the fifteen different resistance values offered by VATS. Because of the small dimensions of these slots it is useful to have them formed in a thin metal plate 8 which is fixed to the key by deforming the metal of the key over tabs on the plate. Dirt accumulation in the plate slots will be minimized if the ratio of slot width to plate thickness is greater than unity.

Alternatively, holes of varying diameter (shown in phantom in FIG. 6) may be used in place of slots. The holes can be located on the lower shaft portion of the key.

There are numerous other possibilities for designing a key for use with the system of the invention. For example, it is possible to use the first four cuts starting from the tip of a conventional key for the mechanical portion of the lock and the last two cuts for a key shape reader. It is desirable to continue to use a mechanical portion of the lock for automotive applications so that the steering wheel can not be rotated when the car is locked, as mandated by Federal Safety Regulations. By devoting the last two cuts in the key to a shape reader, the total number of shape combinations will be $5 \times 5 = 25$ for GM keys. By limiting the design to different adjacent cut levels in at least the last two cut positions, to simplify the detection electronics, the number of possible shapes is reduced to twenty.

Alternatively, it is possible to use a nonstandard key blank that is longer than the standard key blank to include eight cuts instead of the standard six. The first six cuts provide the same mechanical security as in present General Motors' locks, while the last two cuts are devoted to shaped reading.

Still further key designs may include a series of unconventional cuts in a standard metal key blank that can be optically read; for example, a series of narrow, comb-like cuts of variable spacing on the opposite side of the key from the conventional cuts, or a series of holes of varying diameter in the lower shaft portion of the key.

The use of the security system of the invention for motor vehicles has advantages beyond heightened security. For example, the electrical switch associated with the ignition lock has always been troublesome and relatively expensive for automobile manufacturers. The inclusion of a shape reader in the ignition lock can eliminate the electrical switch by having the light emitting diode and photodiode turn on whenever the driver's door is unlocked. In this manner, the shape reader can be used instead of the electrical switch to detect the insertion and removal of the key from the ignition.

Figure 7A:
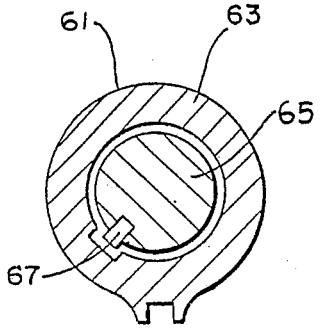
FIG. 7A is a cross sectional view of a typical ignition lock.
Figure 7B:
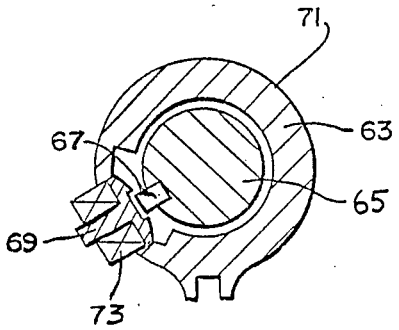
FIG. 7B shows a modified structure that can be electronically released or released by a conventional key.

FIG. 7A shows a cross section of a typical ignition lock 61 used by General Motors. The outer shell 63 is fixed in the steering column. The toner core 65 is prevented from rotation by the sidebar 67 unless a valid key is inserted in the lock. In this case, the sidebar moves towards the center of the core until its outer surface is flush with the cores surface. FIG. 7B is a modified ignition lock 71. This lock can also be released with a key. Alternatively, it can be released by electrically energizing the solenoid 73, which withdraws an element 69 normally retaining the sidebar 67.

A further advantage of the shape reader is that the light emitting diode can serve the dual function of illuminating the key hole and reading the shape of the key inserted therein. This advantage may be optimized by making the exposed portion of the ignition lock from a strong but transparent plastic material.

Several modifications of the key shape reader can be made to improve its performance. To avoid the possibility of stray ambient light interfering with the key shape reader, the light emitting diode should be modulated on and off at a relatively high frequency, up to 100 KHz, so that the well known advantages of timed AC detection can be used. In order to avoid inaccurate readings due to dirt accumulation in the optical path between the light emitting diode and the photodiode, the chamber can be filled with a durable transparent material such as lucite, glass or even sapphire for extreme scratch resistance. Once the chamber is filled, the tendency for dirt accumulation will be greatly reduced.

While the security system of the invention is particularly adapted for use with motor vehicles, it has much wider applicability to any system employing a key lock. In addition, the system of the invention can be combined with other security systems to provide versatility. For example, the system can be used in conjunction with the optical system disclosed in U.S. Pat. Nos. 4,573,046 and 4,665,397, the disclosures of which are hereby incorporated by reference. In such systems, the processing means is programmed to analyze the photoelectrical signal generated by the optical key shape reader or a photoelectrical signal generated by an optical transmitting unit as described in the aforementioned patents. Either signal is sufficient to operate the ignition.

While the present invention has now been described in terms of certain preferred embodiments, one skilled in the art will readily appreciate that various modifications, changes, omissions and substitutions may be made without departing from the spirit thereof. It is intended, therefore, that the present invention be limited solely by the scope of the following claims.

I claim:

1. A security system comprising:

means for photoelectrically deriving an electrical signal from a shape characteristic of a key said shape characteristic being the cuts of varying depth on one edge of the shaft of the key, a single linear series of holes of varying diameter in the shaft of the key, or a single linear series of slots of varying heights in the shaft of the key;

means remote from said photoelectrical means for comparing said electrical signal to one or more electrical signals stored in memory to determine whether they are the same; and means for enabling a function upon determination that said photoelectrically derived electrical signal is the same as said electrical signal stored in memory.

2. The security system of claim 1, further comprising means for disabling the security system for a predetermined time delay if the photoelectrically derived electrical signal is different from the electrical signal stored in memory.

3. The security system of claims 1 or 2 wherein said means for photoelectrically deriving an electrical signal from a shape characteristic of a key comprises light emititing means and light receiving means disposed in a fixed shell upon opposite sides of a passageway for receiving a key in a rotatable inner member disposed within said fixed shell of a lock mechanism.

4. The security system of claim 3, wherein said passageway is within an ignition lock for a motor vehicle.

5. The security system of claims 1 or 2, wherein said means remote from said photoelectrical means is located behind the dashboard of the motor vehicle.

6. The security system of claim 3, wherein said photoelectrical means generates an electrical signal based upon the intensity of light received by said light receiving means.

7. The security system of claim 6, wherein the intensity of light received by said light receiving means is varied by the shape of a key inserted into the key receiving chamber.

8. The security system of claim 7, wherein said key has four cuts for operating a mechanical lock and two cuts for varying the intensity of light receiving by said light receiving means.

9. The security system of claim 6, wherein the intensity of light received by said light receiving means is varied by the shape of slots in the upper shaft portion of a key inserted into the key receiving chamber.

10. The security system of claim 6, wherein the intensity of light received by said lighting receiving means is varied by the diameter of holes in the lower shaft portion of the key.

11. The security system of claim 3, wherein said light emitting means illuminates said passageway for receiving a key.

12. The security system of claim 3, wherein said light emitting means is a light emitting diode modulated at a frequency up to 100 KHz.

13. The security system of claims 1 or 2, wherein said memory is a nonvolatile memory.

14. The security system of claim 13, wherein the nonvolatile memory can be reset with a manual switch associated with said means remote from said photoelectrical means for comparing one or more electrical signals stored in memory.

15. The security system of claim 13, wherein said comparing means is enabled only after an ignition lock is turned to the start position.

16. The security system of claims 1 or 2, wherein the first photoelectrically derived electrical signal is stored in a nonvolatile memory unit in said means remote from said photoelectrical means and all subsequent signals are compared to this first signal to determine if they are the same.

* * * * *